US005505303A

United States Patent [19]

Sirman

[11] Patent Number: 5,505,303

[45] Date of Patent: Apr. 9, 1996

[54] TOOL BOX APPARATUS

[76] Inventor: Levi J. Sirman, 9863 Mahan Dr., Tallahassee, Fla. 32308

[21] Appl. No.: 349,602

[22] Filed: Dec. 5, 1994

[51] Int. Cl.[6] ..... B65D 85/28

[52] U.S. Cl. ..... 206/373; 206/372; 206/349; 206/561; 220/523

[58] Field of Search ..... 206/15.2, 15.3, 206/225, 349, 372, 373, 561; 220/523, 524, 553, 735

[56] References Cited

U.S. PATENT DOCUMENTS

| | | | |
|---|---|---|---|
| 3,674,132 | 7/1972 | Loss | 206/561 |
| 4,303,188 | 12/1981 | Calabrese | 224/253 |
| 4,416,372 | 11/1983 | Polk | 206/372 |
| 4,460,085 | 7/1984 | Jantzen | 206/372 |
| 4,550,828 | 11/1985 | Baldwin et al. | 206/373 |
| 4,613,041 | 9/1986 | Carlton | 206/373 |
| 4,714,158 | 12/1987 | Oltman et al. | 206/561 |
| 4,773,690 | 9/1988 | Heinegg | 206/373 |
| 4,817,808 | 4/1989 | Bracy | 220/524 |
| 4,887,713 | 12/1989 | Tupper | 206/225 |
| 4,989,734 | 2/1991 | Mode et al. | 206/373 |
| 5,370,263 | 12/1994 | Brown | 206/373 |

*Primary Examiner*—David T. Fidei
*Attorney, Agent, or Firm*—Carnes, Cona, Dixon

[57] ABSTRACT

The present invention comprises a tool box apparatus that is used to carry and store the tools and equipment that are commonly used by individuals who plaster or drywall. The tool box apparatus of the present invention includes a first wall that is parallel to a second wall, an opened top and an enclosed bottom. The first portion includes a plurality of parallel slots for receiving and maintaining blades that are used by drywallers. The second portion includes a compartment that is used for storing other commonly used items by individuals who drywall. This second portion can be provided with a cover or lid.

20 Claims, 4 Drawing Sheets

TOOL BOX APPARATUS

BACKGROUND OF THE INVENTION

1. Field of the Invention

The present invention relates generally to a tool box apparatus and more particularly to a tool box apparatus that is used to store and protect a variety of equipment and materials that are commonly used by individuals who work with dry wall or plaster.

2. Description of the Prior Art

Individuals who work with drywall or plaster normally utilized a wide variety of specialized equipment and tools, such as a plurality of various sized blades, drywall tape, sandpaper, mud pan and the like. Typically, the equipment and tools are inefficiently stored, housed, and carried to job sites in boxes or buckets. This arrangement provides for the tools to be susceptible to damage due to continual impact with each other as well as the possibility of hammers, power tools, or the like, being accidentally dropped and colliding with the items stored. Attempts have been made to provide for a tool box apparatus that will safely maintain the blades that are used by an individual who drywalls or plasters.

For example, U.S. Pat. No. 4,303,188, issued to Calabrese, discloses a caddy which includes a plurality of slots. These slots are used to provide a friction engagement with the knives carried therein. Calabrese is silent to the use of other compartments to store and maintain separate commonly employed tools or instruments used by an individual who drywalls or plasters.

U.S. Pat. No. 4,416,372, issued to Polk, discloses a drywaller's tool box. Polk discloses a tool box that includes a blade holding rack that consists of a plurality of graduated parallel slots. Polk further discloses two triangular compartments that are defined alongside the blade holding rack. Though Polk does disclose separate compartments, these compartments are limited in capacity and utility. Additionally, the use of graduated parallel slots also limits the number and sized blades that can be stored. Further, Polk fails to disclose a means of circulating air within the area of the blade holding rack.

None of these previous efforts, however, provide the benefits intended with the present invention. Additionally, prior techniques do not suggest the present inventive combination of component elements as disclosed and claimed herein. The present invention achieves its intended purposes, objectives and advantages over the prior art device through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention provides for an extremely efficient tool box that is used by an individual who drywalls or plasters. The tool box apparatus of the present invention consists of at least two sections. A first section includes a plurality of slots that house and protect the various blades used by a drywaller. The second includes a hollow compartment that is used to store other equipment used by drywallers, such as, but not limited to, sandpaper, mallet, snips, drywall tape, and lubricant. A lid is used to cover the second hollow compartment. Optionally, the mud pan can be located above the compartment with its opened end facing the hollow compartment, so that the mud pan can act as a lid or its opened end can face away from the hollow compartment so that the mud pan can be used to store additional material.

The tool box apparatus of the present invention can be modified to include a plurality of optional features. One such feature would be to include a holding bracket to be internally mounted on the tool box apparatus. This holding bracket would be used for securing a lubricant or brush within the tool box apparatus. The side wall of the tool box apparatus can also include a rope having a first end and second end. The first end would be attached to the side wall of the tool box apparatus while the second end would include a bar attached perpendicularly to the rope. This arrangement would permit for the rope and bar to receive and maintain a multiplicity of drywall tape.

A lid or cover can be attached to the tool box apparatus to provide for an added protection means for the apparatus. This lid could also enable the tool box apparatus to operated as a footstep.

Accordingly, it is the object of the present invention to provide for a tool box apparatus that will efficiently protect, house, and organize a variety of tools, equipment, and materials that are commonly used with drywalling or plastering.

It is yet another object of the present invention to provide for a tool box apparatus that is easy to use and maintain.

A final object of the present invention, to be specifically enumerated herein, is to provide a tool box apparatus in accordance with the preceding objects and which will conform to conventional forms of manufacture, be of simple construction and easy to use so as to provide a device that would be economically feasible, long lasting and relatively trouble free in operation.

Although there have been a few inventions related to a vehicle cover apparatus, none of the inventions have become sufficiently compact, low cost, and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1A:
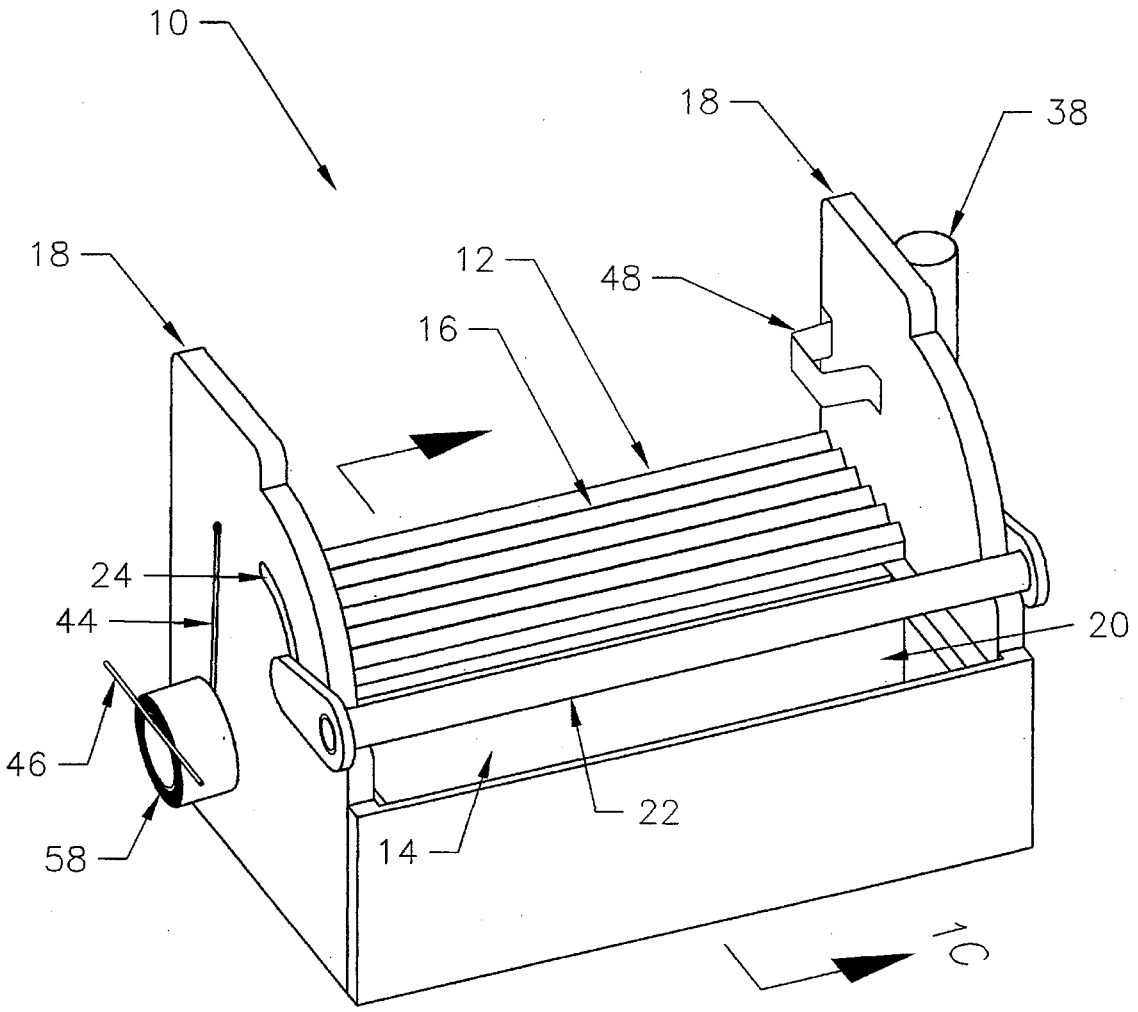
FIG. 1A is a perspective view of the tool box apparatus of the present invention.
Figure 1B:
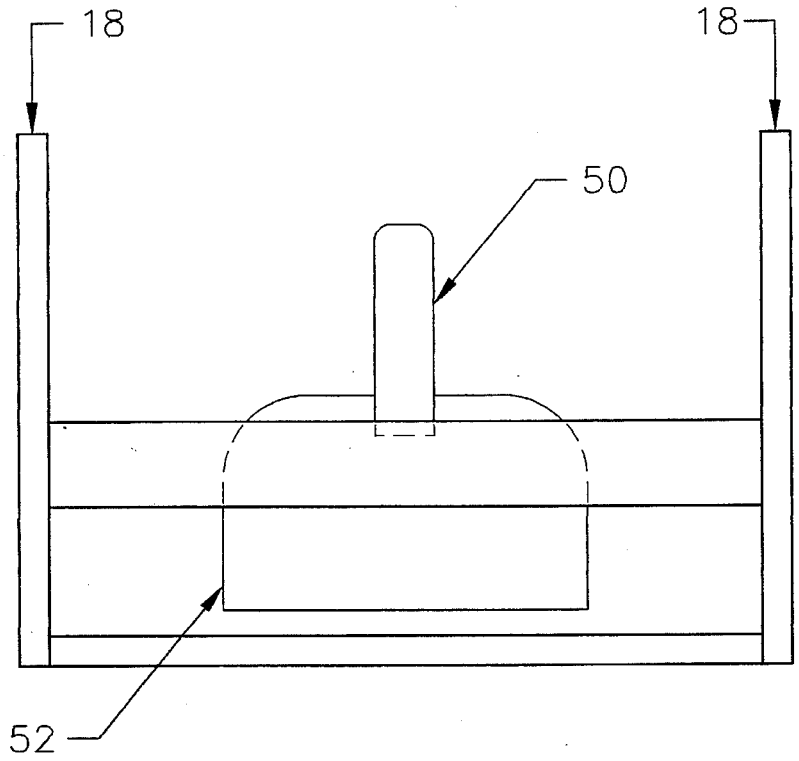
FIG. 1B is a back view of the tool box apparatus of the present invention.
Figure 1C:
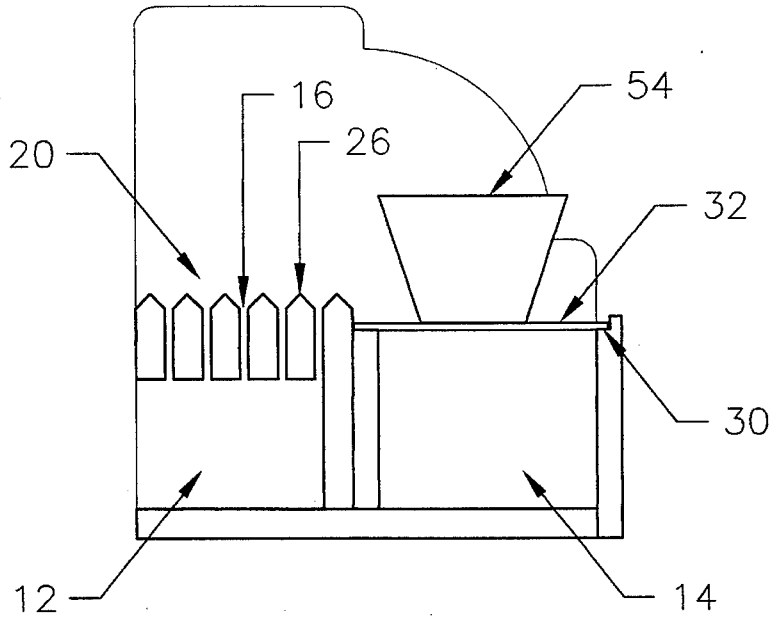
FIG. 1C is a cross sectional view of the tool box apparatus taken along lines 1*c*—1*c* of FIG. 1*a*.

As illustrated in FIGS. 1A–1C, the first embodiment of the tool box apparatus 10 of the present invention consists two side walls 18 parallel to each other, a bottom wall (illustrated in FIGS. 1B and 1C, but not labeled), an opened top 20, a first portion 12 and a second portion 14. A handle 22 is located on the side walls 18. These figures illustrate the handle 22 to be exteriorly attached to the side walls of the tool box apparatus 10. However, it is noted that this handle 22 can be attached interiorly and provide the same results.

This handle can be hingedly attached to the side wall (illustrated in FIG. 2A) or can be attached as illustrated in FIG. 1A. As seen in this figure, a groove 24 is exteriorly located on each side wall of the tool box apparatus 10. The handle 22 includes a first end and a second end. Each end includes an enlarged section (not illustrated) that is received in the groove and can extend into the side walls 18 of the apparatus 10. This arrangement will permit for the enlarged portion of the handle 22 to slide freely within the groove 24. Thereby, permitting the handle 22 to be lowered when the tool box apparatus is being utilized or stored or raised when the tool box apparatus 10 is carried.

It is noted that the handle 22 can be altered to provide for a separate attachment. Though not separately illustrated, the groove would be enlarged and would be located in closed proximity to the edge of the side walls. This groove would also extend through the side wall to provide for the groove to be a through hole. The handle would consists solely of an elongated shaft that extends through the groove. The ends of the handle would pass through the groove and the ends would also include an enlarge portion in order to maintain the handle within the side walls of the tool box apparatus.

Figure 2A:
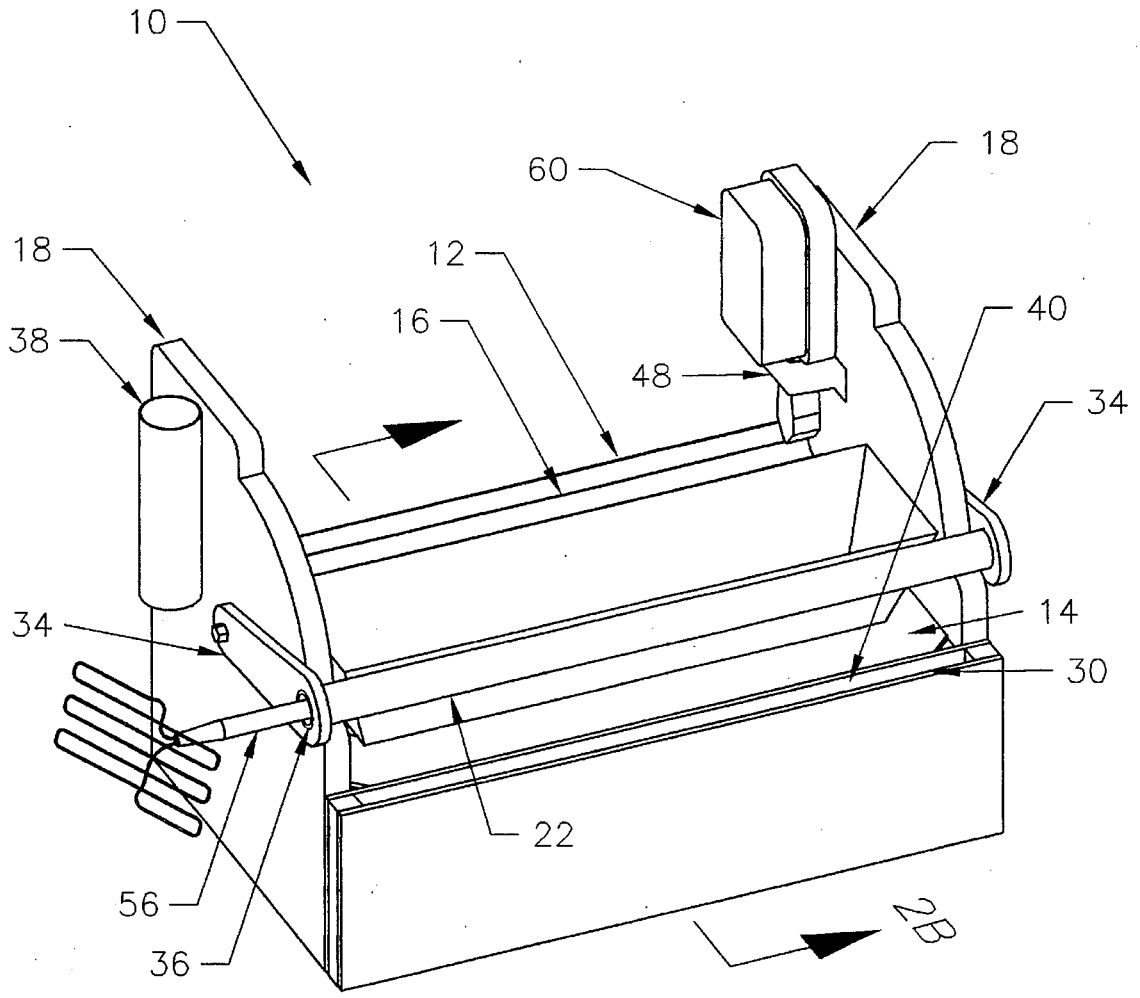
FIG. 2A is a perspective view of a second embodiment of the tool box apparatus of the present invention including various optional attachment means.
Figure 2B:
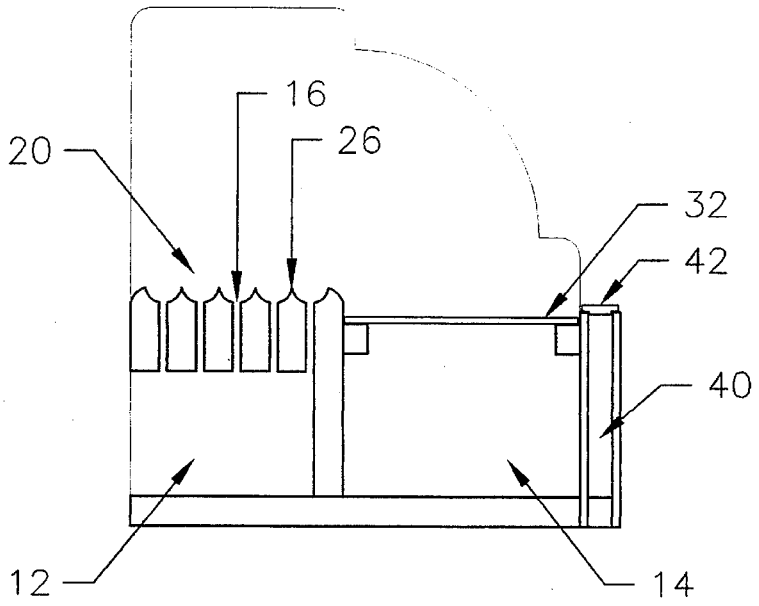
FIG. 2B is a cross sectional view of the tool box apparatus taken along lines 2*b*—2*b* of FIG. 2*a*.

The first portion 12 of the tool box apparatus be includes a plurality of sub-compartments 16. These sub-compartments 16 are a series of parallel slots which are formed by a plurality of dividers or walls 26. The dividers or walls 26 are internally attached to the side walls 18 of the tool box apparatus 10. Between two consecutive walls or dividers are slots which receive each individual blade. The top edge of each divider or wall is either tapered as illustrated in this embodiment or curved as illustrated in FIG. 2B, the second embodiment. The tapering provides an easily means for the user to insert the blades. This tapering also inherently forms a stop for the handle(s) 50 of the blade(s) 52. As illustrated in FIG. 1B, the back view of the tool box apparatus, the dividers or walls 26 are attached such that once the blades are inserted into the sub-compartments, the edge of the blades will not contact the bottom wall of the tool box apparatus. Thereby, increasing the life span of the blade by eliminating any possibility of dulling the blade. The combination of the slots and the blades not contacting the bottom wall of the tool box apparatus also provides an additional protection means by eliminating any possibility of bending the blades should a power tool or the like were to be accidentally dropped on the handles of the tools. Further, by the blades not touching or contacting the bottom wall of the tool box apparatus also enables the excess moisture or excess lubricant to drip from the blades after they have been cleaned.

As also illustrated in FIG. 1B, the walls or dividers 26 of each sub-compartment 16 do not contact the bottom wall of the tool box apparatus 10. This provides a gap to exists between the bottom wall and each wall or divider. The gap will render a means for air to circulate freely about the blades and to aid in the drying process of the blades. By providing for the walls or dividers 26 of each sub-compartment 16 not to extend to the bottom wall not only provides added ventilation for the box, but also provides a means of cleaning the area located underneath the blades.

The second portion 14 of the tool box apparatus includes a storage compartment that extends across the entire length of the tool box apparatus 10. This second portion is ideal for storing miscellaneous items that are commonly used by individuals who plaster or dry wall. The second portion of the apparatus of the present invention includes an edge 30. Located above the second storage compartment is a cover 32. A mud pan 54 can be located on this cover 32. The enclosed end of the mud pan can be situated on the cover to permit for an additional storage compartment to be inherently formed by the mud pan 54.

It is noted that the edge is not needed in the tool box apparatus of the present invention.

The tool box apparatus 10 of the present invention can include a plurality of options to be attached thereto. These options can include, but not be limited to, a bracket 48, a hollow tube 38, and a T-shape apparatus 44 and 46. The bracket 48 can be used for receiving a brush or the like. It is noted that the bracket illustrated is rectangular in shape, however the bracket can be altered to provide for a circular shape. This circular shape would enable the bracket to receive canned lubricants or the like. The hollow tube 38 can be used for receiving any tubular objects, such as a mixing stick or the like. The T-shape apparatus includes a rope or chain 44 that is perpendicularly attached to a bar 46. This will permit for dry wall tape 58 to be attached to the T-shape apparatus.

The above-describe tool box apparatus can be altered to include an additional section for more storage capacity. The alterations are illustrated in FIGS. 2A and 2B, the second embodiment of the tool box apparatus of the present invention. As illustrated in these figures, the tool box apparatus 10 is similar in design and structure to the tool box apparatus as illustrated in FIGS. 1A–1C. Accordingly, the second embodiment of the tool box apparatus 10 of the present invention includes two side walls 18 parallel to each other, a bottom wall (illustrated but not labeled), an opened top 20, a first portion 12, a second portion 14, and a third portion 40. A handle 22 is either internally or externally located on the side walls.

This handle can be hingedly attached to the side wall (illustrated in FIG. 2A) or can be attached as illustrated in FIG. 1A. As seen in this figure (FIG. 2A), a handle 22 is hingedly attached to the side walls 18 of the tool box apparatus and includes two side shafts 34 and a main shaft (illustrated, but not labeled) perpendicular and between the side shafts 34. This main shaft can be hollow to provide for a hollow main shaft to include an opened first end and an opened second end. As illustrated this hollow main shaft can receive a sand pole or the like. As illustrated in FIG. 2A, the hollow main shaft receives a mixing paddle 56. A hollow tube 38, can be exteriorly located on a side wall of the tool box apparatus, can receive a mixing paddle, or the like. This hollow tube 38 includes an opened top and an opened bottom. The opened top receives the handle of the mixing paddle or the like and permits for the handle of the mixing paddle to extend though the opened bottom. Accordingly, when the apparatus is lifted, the handle of the tube falls through the hollow tube and terminate in axial movement when the top area of the paddle contacts the opened top of the tube.

The first portion 12 of the tool box apparatus includes a plurality of sub-compartments 16. These sub-compartments are a series of parallel slots which are formed by a plurality of dividers or walls 26. The dividers or walls are internally attached to the side walls of the tool box apparatus. The top edge of each divider or wall is either tapered as illustrated in the first embodiment or concaved as illustrated in this embodiment (FIG. 2B). The concaved portions provide an easily means for the user to insert the blades. This concaved portion, like the tapering, also inherently forms a stop for the handle of the blade(s). This stop for the handle of the blade(s) is illustrated in FIG. 1C. The dividers or walls 26 are attach such that once the blades are inserted into the sub-compartments, the edges of the blades will not contact the bottom wall of the tool box apparatus (though not illustrated in this embodiment, it is illustrated in FIG. 1C, the first embodiment of the present invention). Thereby increasing the life span of the blade by eliminating any possibility of dulling the blade. The side wall of the tool box apparatus of the present invention is attached, designed, and configured in the same manner as discussed and illustrated in FIGS. 1*a*–1*c*, the first embodiment of the present invention.

The second portion 14 of the tool box apparatus includes a storage compartment that extends across the entire length of the tool box apparatus 10. This second portion is identical is design and structure as the second portion illustrated in the first embodiment (illustrated in FIGS. 1A and 1B).

The third portion 40 of the tool box apparatus includes a storage compartment that extends across the entire length of the tool box apparatus 10. This third portion is ideal for storing sand paper or the like. The third portion 40 can also include a lid 42 for protecting and covering the items stored within the third compartment.

The tool box apparatus can also include a plurality of optional features. For example, a rope or chain like device 44 can be attached to the side wall 18 of the tool box apparatus. A bar 46 is attached perpendicularly to the rope or chain like device 44 to provide for the device to have a T-shape. This T-shape device can be used for holding and maintaining drywalling tape 58.

A second optional feature would be a bracket 48 having an opening for receiving a plurality of objects such as a brush 60 or the like. The bracket illustrated in FIG. 2A consists of a rectangular cross section. However, it is noted that this cross section can be circular to provide for the bracket to hold and maintain a can lubricant, can beverage or the like.

Figure 2C:
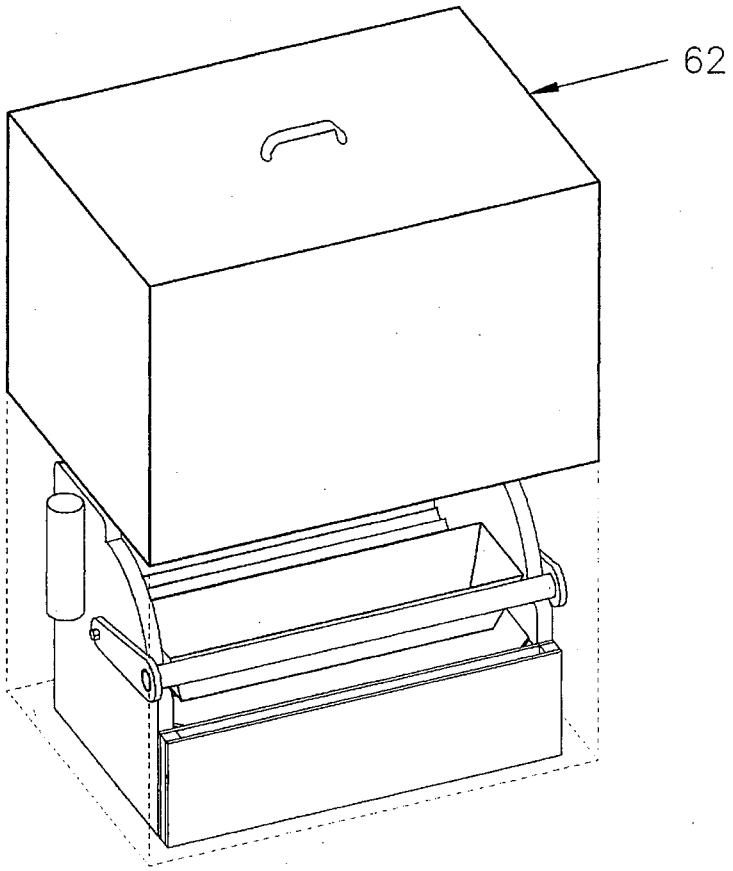
FIG. 2C is a perspective view of the tool box apparatus including the lid of the present invention.

A third lid 62 may be secured to the tool box apparatus of the first or second embodiments, as illustrated in FIG. 2C. This will provide for the structure to be used as a step stool. Though not separately illustrated, the third lid 62 can be securely fastened to the side walls of the tool box apparatus by a conventional locking means. In this configuration there would be no hollow tube and the handle would be internally attached to the side walls.

It is noted that the first portion of the tool box apparatus illustrated in the first and second embodiments can be altered. Though not separately illustrated, this alteration will provide for the first portion to include a rectangular-shape solid material (i.e. wood, metal) to be located between the side wall. The solid material would include a plurality of evenly spaced slits that are aligned in a parallel relation. The blades would be inserted into the slits. The location of the solid material would be such that once the blades are inserted, a gap would exists between the bottom wall and the blades.

This design and configuration will provide for the blades to be inserted via the slots while eliminating the use of walls or dividers. Inherently, reducing the cost and the amount of material needed.

While the invention has been particularly shown and described with reference to an embodiment thereof, it will be understood by those skilled in the art that various changes in form and detail may be made without departing from the spirit and scope of the invention.

I claim:

1. A drywalling or plastering tool box apparatus comprising:

a first side wall parallel to a second side wall;

a bottom wall perpendicular to said first side wall and said second side wall;

a first portion and a second portion;

said first portion having a plurality of dividers that form a plurality of sub-compartments having vertical slots that extend horizontally from said first side wall to said second side wall for receiving and maintaining blades and a gap is located between said plurality of dividers and said bottom wall for aiding in circulating air within said first portion; and said second portion is a storage compartment that extends horizontally from said first side wall to said second side wall.

2. The tool box apparatus as in claim 1 wherein said second portion includes a lid.

3. The tool box apparatus as in claim 2 wherein said lid is removably secured to said second portion.

4. The tool box apparatus as in claim 1 wherein each plurality of dividers include a tapered top edge.

5. The tool box apparatus as in claim 1 wherein each plurality of dividers include a concaved top edge.

6. The tool box apparatus as in claim 1 wherein a handle is secured to said first side wall and said second side wall.

7. The tool box apparatus as in claim 6 wherein said handle consists of a first shaft hingedly attached to said first side wall and a second shaft hingedly attached to said second side wall and a main shaft located therebetween and perpendicular to said first shaft and said second shaft.

8. The tool box apparatus as in claim 7 wherein said main shaft is hollow.

9. The tool box apparatus as in claim 1 wherein said first side wall or said second side wall include a means of maintaining drywall tape.

10. The tool box apparatus as in claim 9 wherein said means of maintaining said drywall tape includes a chain or rope having a bar perpendicularly attached thereto to provide for a device that is T-shape.

11. The tool box apparatus as in claim 1 wherein said first side wall or said second side wall includes a plurality of fasteners mounted interiorly or exteriorly for maintaining and securing a plurality of drywall tools.

12. The tool box apparatus as in claim 1 further including a third portion that is a storage compartment that extends horizontally from said first side wall to said second side wall.

13. The tool box apparatus as in claim 12 wherein said second portion includes a first lid and said third portion includes a second lid.

14. A tool box apparatus as in claim 1 further including a cover for attaching over said first portion and said second portion for permitting said tool box apparatus to be a step stool when said cover is covering said tool box apparatus.

15. A tool box apparatus as in claim 12 further in including a cover for attaching over said first portion, said second portion, and said third portion for permitting said tool box apparatus to be a step stool when said cover is secured to said tool box apparatus.

16. A tool box apparatus as in claim 12 wherein said first side wall or said second side wall includes a plurality of fasteners mounted interiorly or exteriorly for maintaining and securing a plurality of drywall tools.

17. A drywalling or plastering tool box apparatus comprising:

a first side wall parallel to a second side wall;

a bottom wall perpendicular to said first side wall and said second side wall;

a first portion and a second portion;

said first portion including a solid material extending perpendicularly from said first side wall and said second said wall;

said solid material having a plurality of evenly spaced slits that extend from said first side wall to said second side wall and said slits form a plurality of sub-compartments that extend horizontally from said first side wall to said second side wall for receiving and maintaining blades and to permit for a gap to exist between said blades and said bottom wall for aiding in circulating air within said first portion; and said second portion is a storage compartment that extends horizontally from said first side wall to said second side wall.

18. The tool box apparatus as in claim 17 wherein said first side wall or said second side wall includes a plurality of fasteners mounted interiorly or exteriorly for maintaining and securing a plurality of drywall tools.

19. The tool box apparatus as in claim 17 further including a third portion is a storage compartment that extends horizontally from said first side wall to said second side wall.

20. A tool box apparatus as in claim 17 further including a first lid removably secured to said second portion and a second lid removably secured to said third portion.

* * * * *